US011473533B1

(12) United States Patent
Dudar

(10) Patent No.: US 11,473,533 B1
(45) Date of Patent: Oct. 18, 2022

(54) SYSTEMS AND METHODS FOR REDUCING HC BREAKTHROUGH

(71) Applicant: Ford Global Technologies, LLC, Dearborn, MI (US)

(72) Inventor: Aed Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/451,271

(22) Filed: Oct. 18, 2021

(51) Int. Cl.
*F02M 25/08* (2006.01)

(52) U.S. Cl.
CPC .... *F02M 25/0809* (2013.01); *F02M 25/0836* (2013.01); *F02M 25/0854* (2013.01)

(58) Field of Classification Search
CPC ..... F02M 25/0809; F02M 25/0836; F02M 25/0854
See application file for complete search history.

(56) References Cited

U.S. PATENT DOCUMENTS 9,255,553 B2 2/2016 Dudar et al.
9,399,970 B2 7/2016 Peters et al.
9,677,512 B2 6/2017 Dudar et al.
10,202,914 B2 * 2/2019 Dudar ..... F02M 25/0854
2007/0186910 A1 * 8/2007 Leone ..... F02M 25/08 123/520
2010/0011746 A1 * 1/2010 Lupescu ..... F02M 26/35 60/299
2015/0090235 A1 4/2015 Pearce et al.
2016/0215734 A1 * 7/2016 Dudar ..... F02M 25/0836
2017/0363055 A1 12/2017 Dudar et al.
2020/0102899 A1 * 4/2020 Andrzejewski .... F02M 25/0854
2021/0071599 A1 * 3/2021 Dudar ..... F02M 25/089
2021/0237030 A1 * 8/2021 Seki ..... B01J 20/28083

FOREIGN PATENT DOCUMENTS

WO 2020187059 A1 9/2020

* cited by examiner

*Primary Examiner* — Phutthiwat Wongwian
*Assistant Examiner* — Anthony L Bacon
(74) *Attorney, Agent, or Firm* — Vincent Matrogiacomo; McCoy Russell LLP

(57) ABSTRACT

Methods and systems are provided for reducing a possibility of hydrocarbon (HC) breakthrough during a diagnostic routine of an evaporative emissions control (EVAP) system. In one example, a method may include, during the diagnostic routine, switching a direction of air-flow through a fuel vapor canister via adjustments to a three-way valve in response to a higher than threshold a change in temperature within the canister.

20 Claims, 7 Drawing Sheets

SYSTEMS AND METHODS FOR REDUCING HC BREAKTHROUGH

FIELD

The present description relates generally to methods and systems for reducing a possibility of hydrocarbon (HC) breakthrough during a diagnostic routine of an evaporative emissions control (EVAP) system.

BACKGROUND/SUMMARY

Vehicle emission control systems may be configured to store refueling vapors, running-loss vapors, and diurnal emissions in a fuel vapor canister, and then purge the stored vapors during a subsequent engine operation. The stored vapors may be routed to engine intake for combustion, further improving fuel economy for the vehicle. In a typical canister purge operation, a canister purge valve coupled between the engine intake and the fuel vapor canister is opened, allowing for intake manifold vacuum to be applied to the fuel vapor canister. Fresh air may be drawn through the fuel vapor canister via an open canister vent valve. This configuration facilitates desorption of stored fuel vapors from the adsorbent material in the canister, regenerating the adsorbent material for further fuel vapor adsorption.

Strict regulations regulate the performance of EVAP systems and regular diagnostics tests are mandated. As such, EVAP systems must be periodically subject to on-board diagnostic testing for leaks and other forms of degradation that could potentially increase emissions. In hybrid vehicles, and other vehicles configured to operate in engine-off or reduced manifold vacuum modes opportunities to test for leaks using manifold vacuum may be infrequent. As such, an additional vacuum source is required for leak testing evaporative emissions systems in these vehicles. In some examples, a vacuum pump is placed between the fuel vapor canister and atmosphere.

However, such vehicles also have infrequent opportunities to purge the fuel vapor canister to the intake of the engine. Subsequently, if a diagnostic test is carried out for the fuel vapor canister while it is saturated with fuel vapor, hydrocarbon breakthrough may occur and result in bleed emissions as well as false leak detection. The application of negative pressure at the fresh air port of the canister, may draw out HCs adsorbed within the canister onto the vent line causing the breakthrough.

One approach for addressing a potential HC breakthrough is described by Dudar et al. in U.S. Pat. No. 9,677,512. Therein, during a diagnostic test of the EVAP system including generating a vacuum on a fuel vapor canister via a dedicated pump, responsive to the EVAP pressure reaching a plateau or inflection point prior to reaching a reference threshold, the vacuum generation is suspended and the diagnostic test is discontinued to reduce the possibility of HC breakthrough from the canister. The diagnostic test may be restarted upon a set of conditions including purge flow summation being higher than a threshold being met.

However, the inventors herein have recognized potential issues with such systems. As one example, by aborting diagnostic tests, it may not be possible to carry out the required number of diagnostics tests to meet regulations. For hybrid vehicles which can operate for prolonged durations without engine operation, conditions for restarting the diagnostics based on purging of the canister may not be frequently met. Restarting the engine solely for carrying out the diagnostics would reduce the fuel efficiency of the vehicle.

In one example, the issues described above may be addressed by a method for an engine, comprising: during a diagnostic routine of a fuel vapor canister of an evaporative emissions control (EVAP) system, switching a direction of air-flow through the canister based on a change in temperature within the canister. In this way, by including alternate routes for evacuating the canister, possibility of HC breakthrough may be reduced.

As one example, a bypass passage may be coupled across a fuel vapor canister and a three-way valve may be coupled to a junction of a first end of the bypass passage and a vent line, the second end of the bypass passage coupled to a purge line. The three-way valve may be actuated to a first position to directly couple a vent port at a second end of the canister to the vent line, and to a second position to couple a purge port of the canister to the vent line. The canister may include a temperature sensor coupled proximal to the vent port of the canister. During an EVAP system diagnostic routine, the three-way valve may be actuated to the first position and the canister may be evacuated by drawing out air via the vent port of the canister while the temperature of the canister is monitored. An increase in temperature proximal to the vent port of the canister may indicate migration of hydrocarbons (HCs) towards the vent port at the second end of the canister. In response to the migration of HCs towards the vent line, the three-way valve may be actuated to the second position and evacuation of the canister may be continued by drawing out air via the purge port and the buffer of the canister. Robustness of the canister may be indicated upon the fuel system pressure decreasing to a threshold pressure within a pre-calibrated duration of the diagnostic routine.

In this way, by adjusting a direction of air flow during evacuation of the canister during a diagnostic routine, possibility of HC breakthrough via the vent port of the canister may be reduced. Since the vent port at the second end of the canister is coupled to the vent line, a HC breakthrough could have caused HCs to be released to the atmosphere. The technical effect of including a three-way valve and the canister bypass passage is that evacuation of the canister and the EVAP system diagnostics routine may be carried out without interruption, thereby improving the frequency of completion of the diagnostics routines as mandated by regulatory agencies. Overall by effectively diagnosing the EVAP system while reducing the possibility of HC breakthrough, emissions quality may be maintained above desired levels.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 2A:
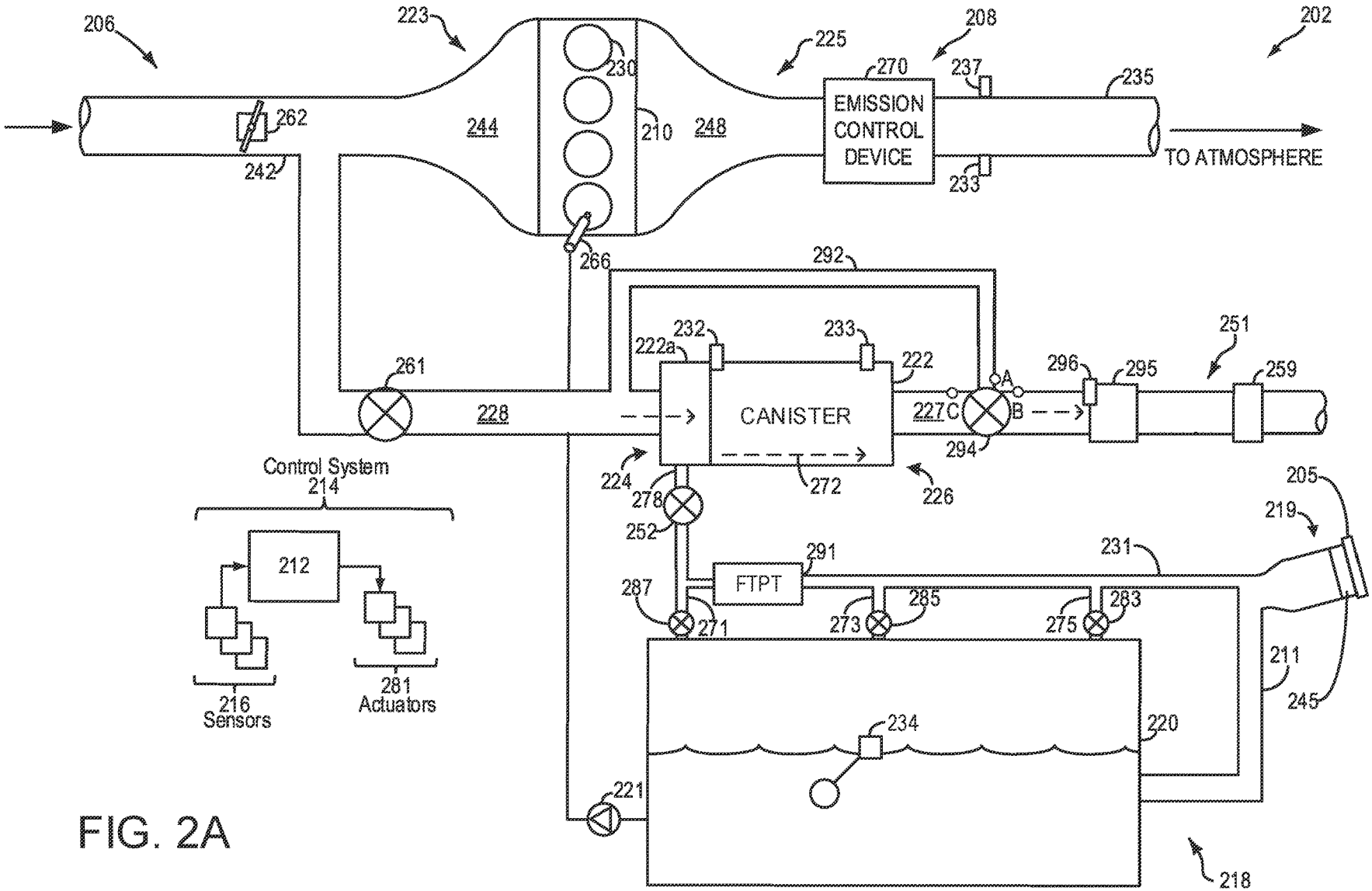
FIG. 2A schematically shows an example vehicle system with a fuel system and an evaporative emissions (EVAP) system operating in a first mode.
Figure 2B:
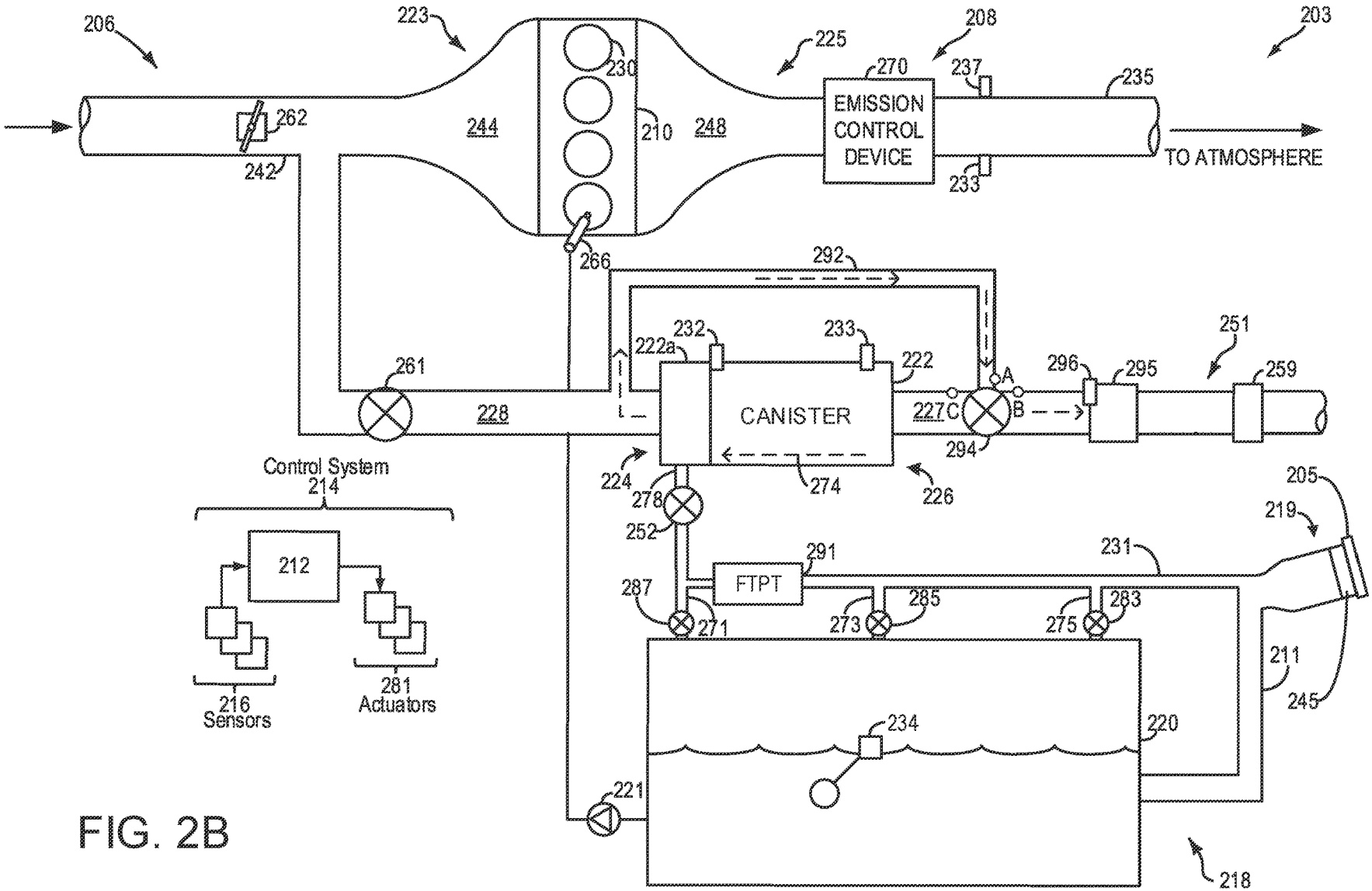
FIG. 2B schematically shows the fuel system and the evaporative emissions system of FIG. 2A operating in a second mode.
Figure 3A:
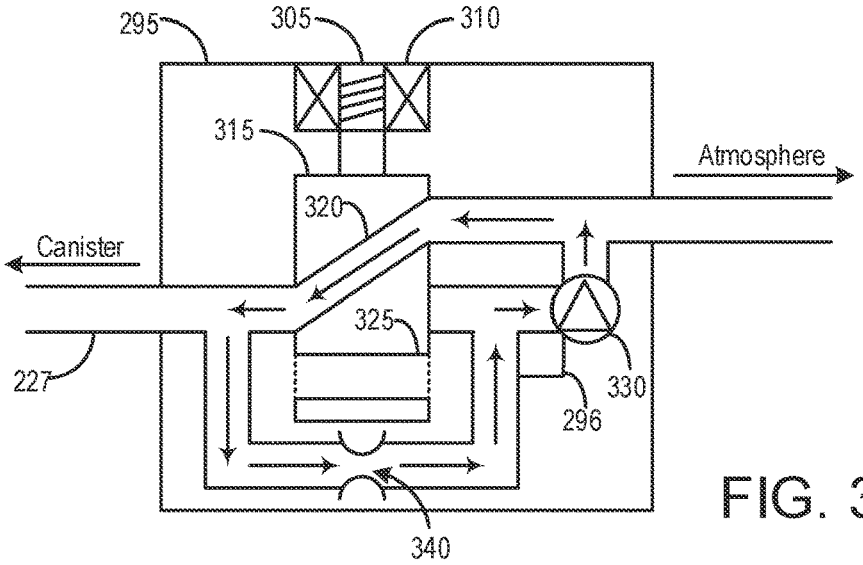
FIG. 3A shows a schematic depiction of an evaporative leak check module in a configuration to perform a reference check.
Figure 3B:
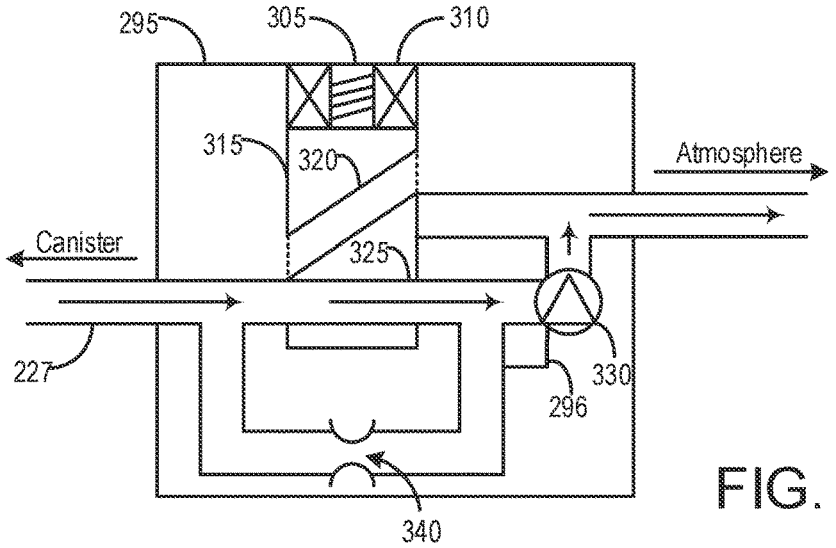
FIG. 3B shows a schematic depiction of an evaporative leak check module in a configuration to perform a fuel system evacuation leak check.
Figure 3C:
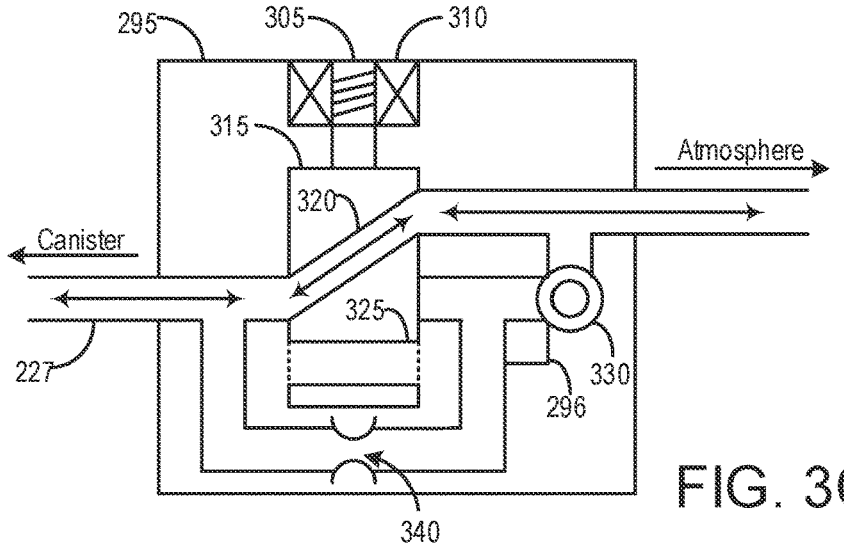
FIG. 3C shows a schematic depiction of an evaporative leak check module in a configuration to perform a purge operation.
Figure 4A:
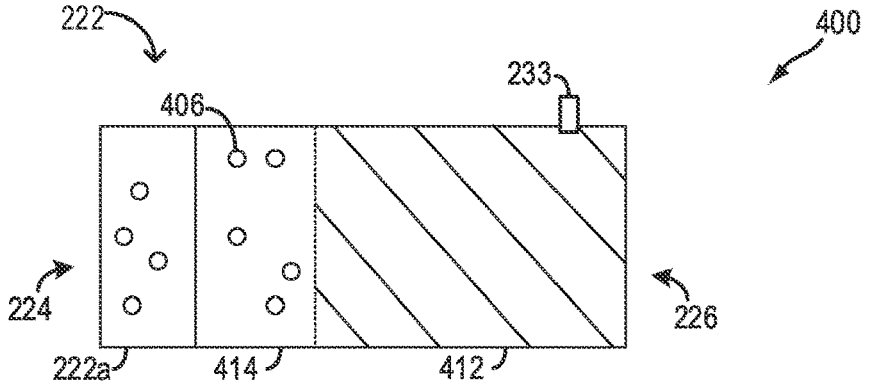
FIG. 4A shows a schematic depiction of a fuel vapor canister immediately after a purge of the canister to the engine intake manifold.
Figure 4B:
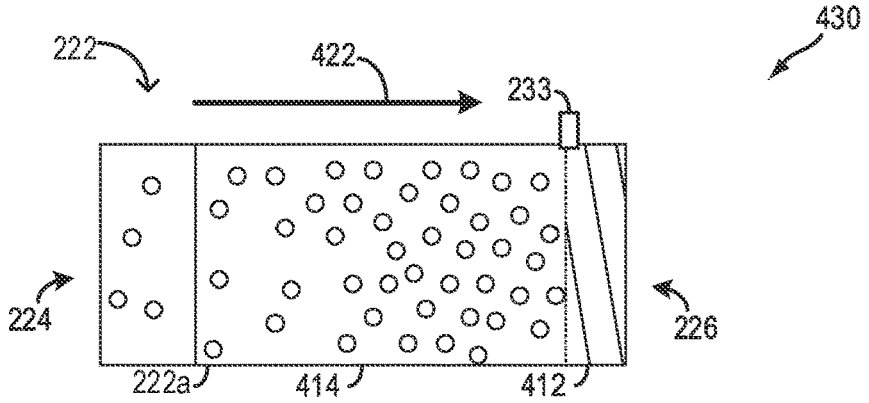
FIG. 4B shows a schematic depiction of a fuel vapor canister during an evacuation of the canister via a vent port of the canister.
Figure 4C:
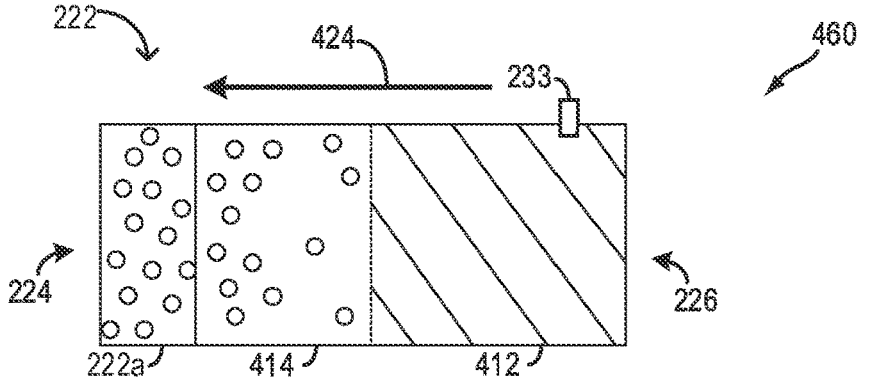
FIG. 4C shows a schematic depiction of a fuel vapor canister during an evacuation of the canister via a purge port of the canister.
Figure 5:
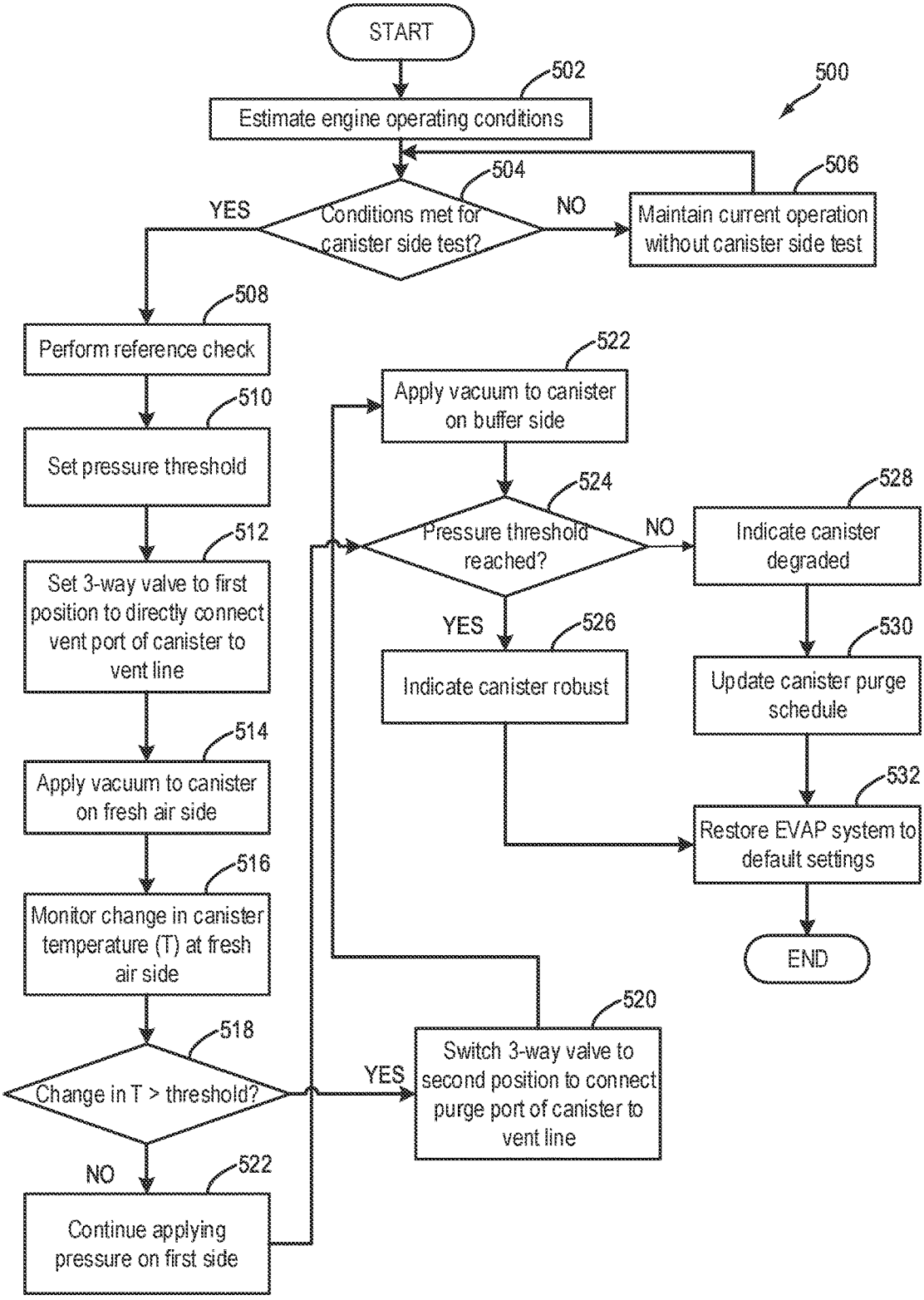
FIG. 5 shows a flow-chart of a method for reducing a possibility of hydrocarbon (HC) breakthrough during a diagnostic routine of the EVAP system.
Figure 6:
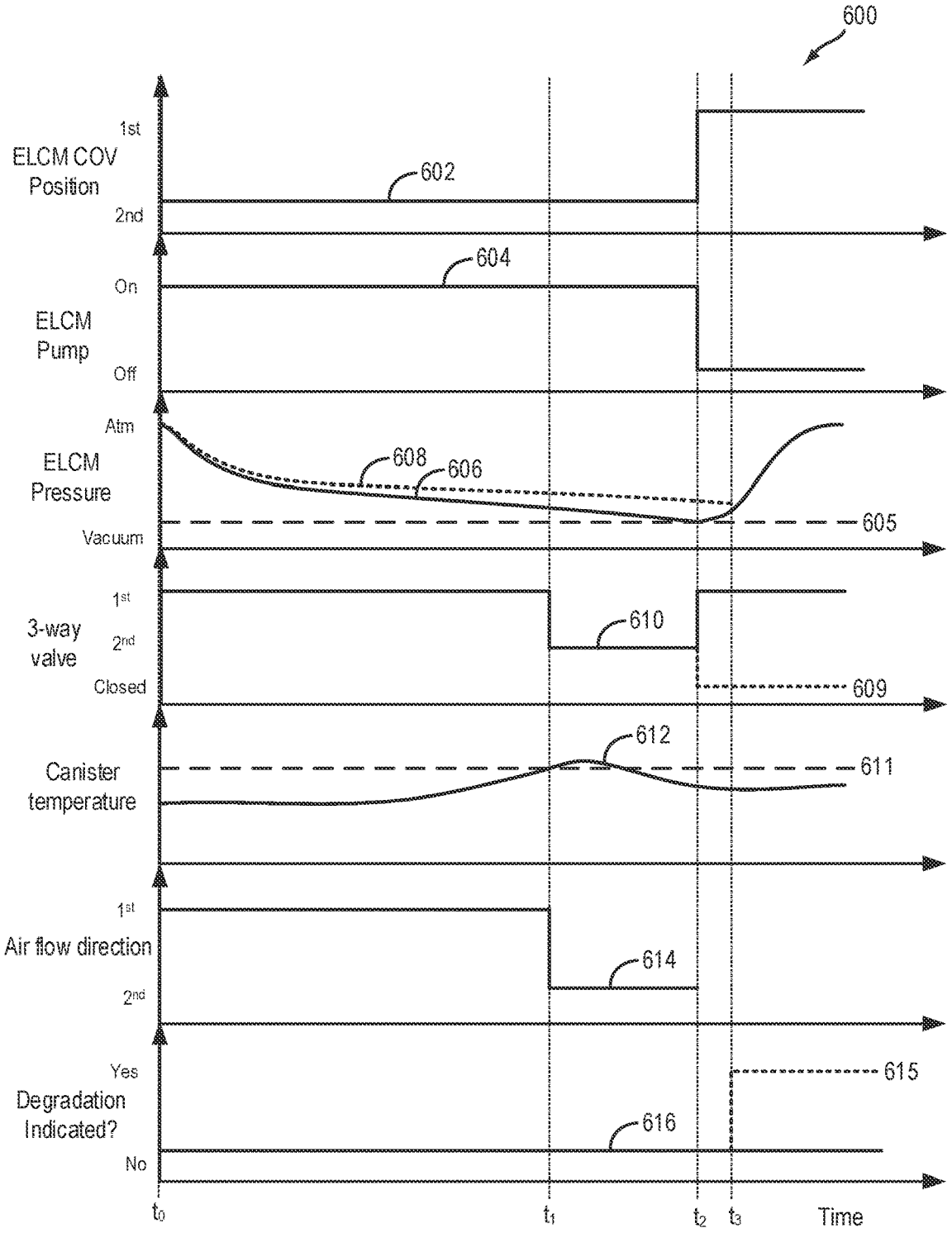
FIG. 6 shows an example timeline for an EVAP system diagnostic routine.

The following description relates to systems and methods for reducing a possibility of hydrocarbon (HC) breakthrough during a diagnostic routine of the EVAP system. The fuel vapor canister may be included in a hybrid vehicle system, such as the hybrid vehicle system shown in FIG. 1. The fuel vapor canister may be configured to capture refueling vapors from a fuel tank, as shown in FIGS. 2A-2B. The evaporative leak check module may be coupled to the fuel vapor canister and configured to draw a vacuum on the fuel vapor canister side of the evaporative emissions system, as shown in FIGS. 3A-3C. Distribution of HCs with the fuel vapor canister is shown in FIGS. 4A-4C. The engine system may include a controller configured to carry out routines, such as shown in FIG. 5, to reduce a possibility of hydrocarbon (HC) breakthrough during a diagnostic routine of the EVAP system. An example timeline of the EVAP system diagnostics is shown in FIG. 6.

Figure 1:
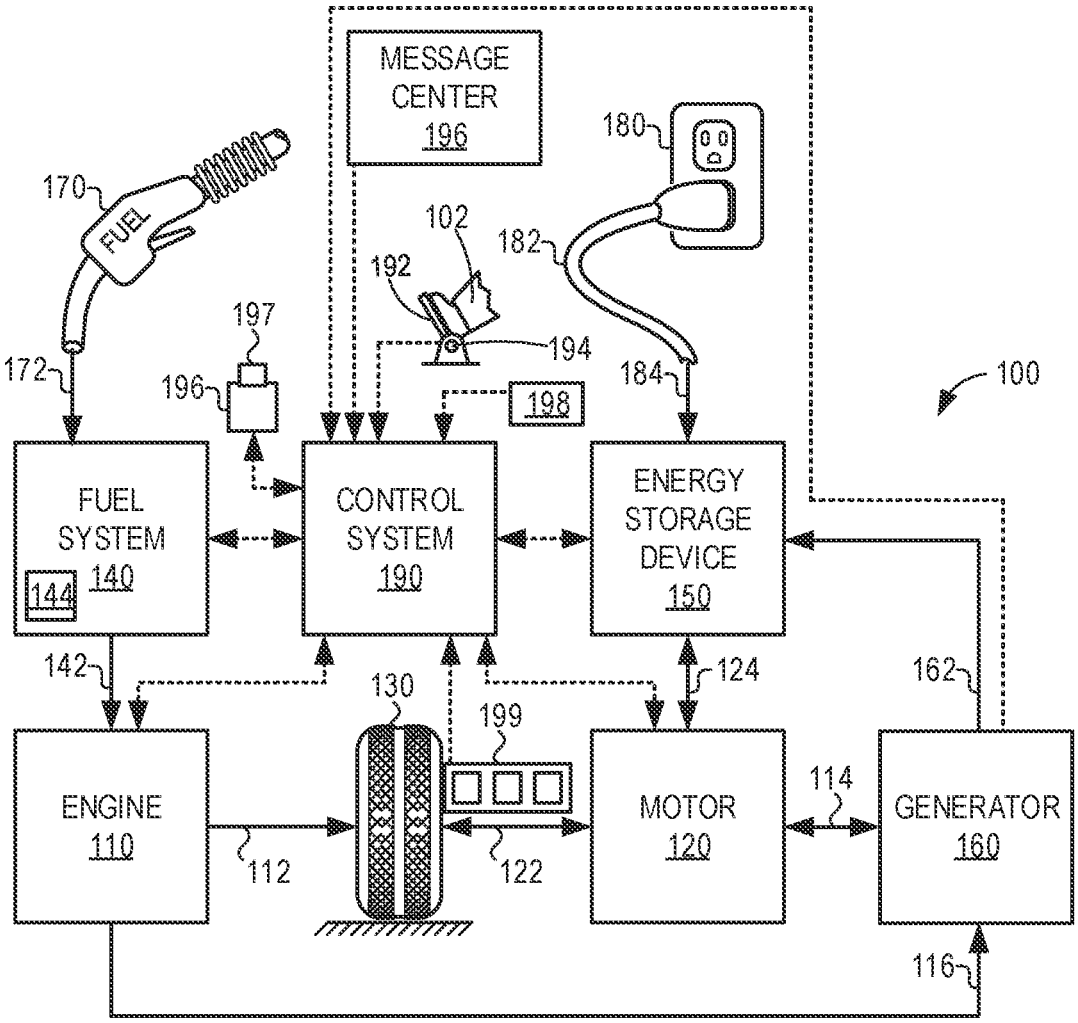
FIG. 1 schematically shows an example vehicle propulsion system.

FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g., gasoline) to produce an engine output while motor 120 may consume electrical energy to produce a motor output. As such, a vehicle with vehicle propulsion system 100 may be referred to as a hybrid electric vehicle (HEV).

Vehicle propulsion system 100 may utilize a variety of different operational modes depending on operating conditions encountered by the vehicle propulsion system. Some of these modes may enable engine 110 to be maintained in an off state (e.g., set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some embodiments. However, in other embodiments, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated. During other operating conditions, both engine 110 and motor 120 may each be operated to propel the vehicle via drive wheel 130 as indicated by arrows 112 and 122, respectively. A configuration where both the engine and the motor may selectively propel the vehicle may be referred to as a parallel type vehicle propulsion system. Note that in some embodiments, motor 120 may propel the vehicle via a first set of drive wheels and engine 110 may propel the vehicle via a second set of drive wheels.

In other embodiments, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160, which may in turn supply electrical energy to one or more of motor 120 as indicated by arrow 114 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

Fuel system 140 may include one or more fuel storage tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g., E10, E85, etc.) or a blend of gasoline and methanol (e.g., M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160.

In some embodiments, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 190 may communicate with one or more of engine 110, motor 120, fuel system 140, energy storage device 150, and generator 160. Control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal.

Energy storage device 150 may periodically receive electrical energy from a power source 180 residing external to the vehicle (e.g., not part of the vehicle) as indicated by arrow 184. As a non-limiting example, vehicle propulsion system 100 may be configured as a plug-in hybrid electric vehicle (HEV), whereby electrical energy may be supplied to energy storage device 150 from power source 180 via an electrical energy transmission cable 182. During a recharging operation of energy storage device 150 from power source 180, electrical energy transmission cable 182 may electrically couple energy storage device 150 and power source 180. While the vehicle propulsion system is operated to propel the vehicle, electrical energy transmission cable 182 may be disconnected between power source 180 and energy storage device 150. Control system 190 may identify and/or control the amount of electrical energy stored at the energy storage device, which may be referred to as the state of charge (SOC).

In other embodiments, electrical energy transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some embodiments, fuel tank 144 may be configured to store the fuel received from fuel dispensing device 170 until it is supplied to engine 110 for combustion. In some embodiments, control system 190 may receive an indication of the level of fuel stored at fuel tank 144 via a fuel level sensor. The level of fuel stored at fuel tank 144 (e.g., as identified by the fuel level sensor) may be communicated to the vehicle operator, for example, via a fuel gauge or indication in a vehicle instrument panel 196.

The vehicle propulsion system 100 may also include an ambient temperature/humidity sensor 198, and a roll stability control sensor, such as a lateral and/or longitudinal and/or yaw rate sensor(s) 199. The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. For example, the vehicle instrument panel 196 may include a refueling button 197 which may be manually actuated or pressed by a vehicle operator to initiate refueling. For example, as described in more detail below, in response to the vehicle operator actuating refueling button 197, a fuel tank in the vehicle may be depressurized so that refueling may be performed.

In an alternative embodiment, the vehicle instrument panel 196 may communicate audio messages to the operator without display. Further, the sensor(s) 199 may include a vertical accelerometer to indicate road roughness. These devices may be connected to control system 190. In one example, the control system may adjust engine output and/or the wheel brakes to increase vehicle stability in response to sensor(s) 199.

Vehicle propulsion system 100 may be coupled within a vehicle system, such as vehicle system 206, as depicted as a first schematic 202 in FIG. 2A. The vehicle system 206 includes an engine system 208 coupled to an evaporative emissions control (EVAP) system 251 and a fuel system 218. Emission control system 251 includes a fuel vapor container or canister 222 which may be used to capture and store fuel vapors. In some examples, vehicle system 206 may be a hybrid electric vehicle system, including a motor, generator, energy storage device, etc. as shown for vehicle propulsion system 100.

The engine system 208 may include an engine 210 having a plurality of cylinders 230. The engine 210 includes an engine intake 223 and an engine exhaust 225. The engine intake 223 includes a throttle 262 fluidly coupled to the engine intake manifold 244 via an intake passage 242. The engine exhaust 225 includes an exhaust manifold 248 leading to an exhaust passage 235 that routes exhaust gas to the atmosphere. The engine exhaust 225 may include one or more emission control devices 270, which may be mounted in a close-coupled position in the exhaust. One or more emission control devices may include a three-way catalyst, lean NOx trap, diesel particulate filter, oxidation catalyst, etc. It will be appreciated that other components may be included in the engine such as a variety of valves and sensors.

Fuel system 218 may include a fuel tank 220 coupled to a fuel pump system 221. The fuel pump system 221 may include one or more pumps for pressurizing fuel delivered to the injectors of engine 210, such as the example fuel injector 266 shown. While only a single fuel injector 266 is shown, additional injectors are provided for each cylinder. It will be appreciated that fuel system 218 may be a return-less fuel system, a return fuel system, or various other types of fuel system. Fuel tank 220 may hold a plurality of fuel blends, including fuel with a range of alcohol concentrations, such as various gasoline-ethanol blends, including E10, E85, gasoline, etc., and combinations thereof. A fuel level sensor 234 located in fuel tank 220 may provide an indication of the fuel level ("Fuel Level Input") to controller 212. As depicted, fuel level sensor 234 may comprise a float connected to a variable resistor. Alternatively, other types of fuel level sensors may be used.

Vapors generated in fuel system 218 may be routed to an evaporative emissions control system 251 which includes a fuel vapor canister 222 via vapor recovery line 231, before being purged to the engine intake 223. Vapor recovery line 231 may be coupled to fuel tank 220 via one or more conduits and may include one or more valves for isolating the fuel tank during certain conditions. For example, vapor recovery line 231 may be coupled to fuel tank 220 via one or more or a combination of conduits 271, 273, and 275.

Further, in some examples, one or more fuel tank vent valves in conduits 271, 273, or 275. Among other functions, fuel tank vent valves may allow a fuel vapor canister of the emissions control system to be maintained at a low pressure or vacuum without increasing the fuel evaporation rate from the tank (which would otherwise occur if the fuel tank pressure were lowered). For example, conduit 271 may include a grade vent valve (GVV) 287, conduit 273 may include a fill limit venting valve (FLVV) 285, and conduit 275 may include a grade vent valve (GVV) 283. Further, in some examples, vapor recovery line 231 may be coupled to a fuel filler system 219. In some examples, fuel filler system may include a fuel cap 205 for sealing off the fuel filler system from the atmosphere. Refueling fuel filler system 219 is coupled to fuel tank 220 via a fuel filler pipe or neck 211.

Further, refueling fuel filler system 219 may include refueling lock 245. In some embodiments, refueling lock 245 may be a fuel cap locking mechanism. The fuel cap locking mechanism may be configured to automatically lock the fuel cap in a closed position so that the fuel cap cannot be opened. For example, the fuel cap 205 may remain locked via refueling lock 245 while pressure or vacuum in the fuel tank is greater than a threshold. In response to a refuel request, e.g., a vehicle operator initiated request, the fuel tank may be depressurized and the fuel cap unlocked after the pressure or vacuum in the fuel tank falls below a threshold. A fuel cap locking mechanism may be a latch or clutch, which, when engaged, prevents the removal of the fuel cap. The latch or clutch may be electrically locked, for example, by a solenoid, or may be mechanically locked, for example, by a pressure diaphragm.

In some embodiments, refueling lock 245 may be a filler pipe valve located at a mouth of fuel filler pipe 211. In such embodiments, refueling lock 245 may not prevent the removal of fuel cap 205. Rather, refueling lock 245 may prevent the insertion of a refueling pump into fuel filler pipe 211. The filler pipe valve may be electrically locked, for example by a solenoid, or mechanically locked, for example by a pressure diaphragm.

In some embodiments, refueling lock 245 may be a refueling door lock, such as a latch or a clutch which locks a refueling door located in a body panel of the vehicle. The refueling door lock may be electrically locked, for example by a solenoid, or mechanically locked, for example by a pressure diaphragm.

In embodiments where refueling lock 245 is locked using an electrical mechanism, refueling lock 245 may be unlocked by commands from controller 212, for example, when a fuel tank pressure decreases below a pressure threshold. In embodiments where refueling lock 245 is locked using a mechanical mechanism, refueling lock 245 may be unlocked via a pressure gradient, for example, when a fuel tank pressure decreases to atmospheric pressure.

Emissions control system 251 may include one or more emissions control devices, such as one or more fuel vapor canisters 222 filled with an appropriate adsorbent, the canisters are configured to temporarily trap fuel vapors (including vaporized hydrocarbons) during fuel tank refilling operations and "running loss" (that is, fuel vaporized during vehicle operation). In one example, the adsorbent used is activated charcoal. Emissions control system 251 may further include a canister ventilation path or vent line 227 which may route gases out of the canister 222 to the atmosphere when storing, or trapping, fuel vapors from fuel system 218.

Canister 222 may include a buffer 222*a* (or buffer region) at a first end 224 of the canister, each of the canister and the buffer comprising the adsorbent. As shown, the volume of buffer 222*a* may be smaller than (e.g., a fraction of) the volume of canister 222. The adsorbent in the buffer 222*a* may be same as, or different from, the adsorbent in the canister (e.g., both may include charcoal). Buffer 222*a* may be positioned within canister 222 such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine. A first temperature sensor 232 may be coupled to the canister proximal to a purge port at the first end 224 of the canister and a second temperature sensor 233 may be coupled to the canister proximal to a vent port at the second end 226 of the canister. The first end 224 of the canister may be proximal to the engine intake manifold (via the purge port and the purge line) while the second end of the canister may be proximal to the atmosphere (via the vent port and the vent line). The first temperature sensor 232 may be positioned at 10% depth of the canister 222 relative to the first end 224, and the second temperature sensor 233 may be positioned at 90% depth of the canister 222 relative to the first end 224. As fuel vapor is adsorbed by the adsorbent in the canister, heat is generated (heat of adsorption). Likewise, as fuel vapor is desorbed by the adsorbent in the canister, heat is consumed. In this way, the adsorption and desorption of fuel vapor by the canister and migration of HCs within the canister may be monitored and estimated based on temperature changes within the canister.

Vent line 227 may also allow fresh air to be drawn into canister 222 when purging stored fuel vapors from fuel system 218 to engine intake 223 via purge line 228 and canister purge valve (CPV) 261. For example, canister purge valve 261 may be normally closed but may be opened during certain conditions so that vacuum from engine intake manifold 244 is provided to the fuel vapor canister for purging. In some examples, vent line 227 may include an air filter 259 disposed therein upstream of a canister 222.

In some examples, the flow of air and vapors between canister 222 and the atmosphere may be regulated by a canister vent valve coupled within vent line 227. When included, the canister vent valve may be a normally open valve, so that fuel tank isolation valve 252 (FTIV) may control venting of fuel tank 220 with the atmosphere. FTIV 252 may be positioned between the fuel tank and the fuel vapor canister within conduit 278. Conduit 278 may be fluidically coupled to vapor recovery line 231, and thus may be coupled to one or more of conduits 271, 273, and 275, either directly or indirectly. FTIV 252 may be a normally closed valve, that when opened, allows for the venting of fuel vapors from fuel tank 220 to canister 222. Fuel vapors may then be vented to atmosphere, or purged to engine intake 223 via canister purge valve 261.

Fuel system 218 may be operated by controller 212 in a plurality of modes by selective adjustment of the various valves and solenoids. For example, the fuel system may be operated in a fuel vapor storage mode (e.g., during a fuel tank refueling operation and with the engine not running), wherein the controller 212 may open fuel tank isolation valve 252 while closing canister purge valve 261 to direct refueling vapors into canister 222 while preventing fuel vapors from being directed into the intake manifold.

As another example, the fuel system may be operated in a refueling mode (e.g., when fuel tank refueling is requested by a vehicle operator), wherein the controller 212 may open fuel tank isolation valve 252, while maintaining canister purge valve 261 closed, to depressurize the fuel tank before allowing enabling fuel to be added therein. As such, fuel tank isolation valve 252 may be kept open during the refueling operation to allow refueling vapors to be stored in the canister. After refueling is completed, the isolation valve may be closed.

As yet another example, the fuel system may be operated in a canister purging mode (e.g., after an emission control device light-off temperature has been attained and with the engine running), wherein the controller 212 may open canister purge valve 261 while closing fuel tank isolation valve 252. Herein, the vacuum generated by the intake manifold of the operating engine may be used to draw fresh air through vent line 227 and through fuel vapor canister 222 to purge the stored fuel vapors into intake manifold 244. In this mode, the purged fuel vapors from the canister are combusted in the engine. The purging may be continued until the stored fuel vapor amount in the canister is below a threshold.

The EVAP system may include a bypass passage 292 coupled across the canister 222. A first end of the bypass passage 292 may be coupled to the purge line 228 proximal to the first end 224 of the canister 222 and a second end of the bypass passage 292 may be coupled to the vent line 227 via a three-way valve 294. The three-way valve 294 may be the canister vent valve allowing fluidic communication between points B and C on the vent line 227, and points A and B on the bypass passage 292 and vent line 227, respectively. As an example, in the first position of the three-way valve 294, there is fluidic communication between points B and C across the three-way valve 294 while the bypass passage 292 is blocked off from the vent line 227 while in the second position of the three-way valve 294, there is fluidic communication between points A and B across the three-way valve 294 while the canister 222 is blocked off from the vent line 227. In the third, closed position of the three-way valve 294, fluidic communication among points A-B-C is suspended.

Controller 212 may comprise a portion of a control system 214. Control system 214 is shown receiving information from a plurality of sensors 216 (various examples of which are described herein) and sending control signals to a plurality of actuators 281 (various examples of which are described herein). As one example, sensors 216 may include exhaust gas sensor 237 located downstream of the emission control device, temperature sensors 232 and 233, and, pressure sensor 291. Other sensors such as pressure, temperature, air/fuel ratio, and composition sensors may be coupled to various locations in the vehicle system 206. As another example, the actuators may include fuel injector 266, throttle 262, fuel tank isolation valve 252, three-way valve 294, and refueling lock 245. The control system 214 may include a controller 212. The controller may receive input data from the various sensors, process the input data, and trigger the actuators in response to the processed input data based on instruction or code programmed therein corresponding to one or more routines. An example control routine is described herein with regard to FIG. 5.

Leak detection routines may be intermittently performed by controller 212 on fuel system 218 to confirm that the fuel system is not degraded. As such, leak detection routines may be performed while the engine is off (engine-off leak test) using engine-off natural vacuum (EONV) generated due to a change in temperature and pressure at the fuel tank following engine shutdown and/or with vacuum supplemented from a vacuum pump. Alternatively, leak detection routines may be performed while the engine is running by operating a vacuum pump and/or using engine intake manifold vacuum. Leak tests may be performed by an evaporative leak check module (ELCM) 295 communicatively coupled to controller 212. ELCM 295 may be coupled in vent line 227, between canister 222 and the atmosphere. ELCM 295 may include a vacuum pump for applying negative pressure to the fuel system when administering a leak test. In some embodiments, the vacuum pump may be configured to be reversible. In other words, the vacuum pump may be configured to apply either a negative pressure or a positive pressure on the fuel system. ELCM 295 may further include a reference orifice and a pressure sensor 296. Following the applying of vacuum to the fuel system, a change in pressure at the reference orifice (e.g., an absolute change or a rate of change) may be monitored and compared to a threshold. Based on the comparison, a fuel system leak may be diagnosed. FIGS. 3A-3C show schematic depictions of example ELCM 295 in various conditions during diagnostics of the EVAP system 251.

The first schematic 202 of the vehicle system 206 as shown in in FIG. 2A shows operation of the EVAP system 251 in the first mode during diagnostics of the EVAP system 251 with the air flow within the canister in a first direction. At the onset of the diagnostic routine, the three-way valve 294 may be actuated to a first position to allow direct fluidic communication between a vent port of the canister and the ELCM pump, while blocking air-flow from the bypass passage 292 of the canister to the vent line. In the first position of the three-way valve, as shown in the first mode, the canister 222 may be evacuated by drawing out air to the pump via the vent port of the canister. Dashed line 272 shows the first direction of air flow through the canister during evacuation of the canister via the vent port. The air flows from the purge port at the first end 224 to the vent port at the second end 226 of the canister and then to the pump of ELCM 295 via the vent line without entering the bypass passage 292. As the air flows in the first direction, HCs may migrate towards the second end 226. A change in temperature within the canister may be monitored during the diagnostic routine via the second temperature sensor 233 coupled within the canister proximal to the vent port of the canister, the change (increase) in temperature signifying a migration of HCs towards the second end. In response to the change in temperature within the canister being higher than a threshold change over a threshold duration of the diagnostics, the direction of air-flow through the canister may be switched from the first direction to the second direction.

A second schematic 203 of the vehicle system 206 as shown in in FIG. 2B shows operation of the EVAP system 251 in the second mode during diagnostics of the EVAP system 251 with the air flow within the canister in the second direction. Switching the direction of air-flow may include actuating the three-way valve 294 to a second position to allow fluidic communication between a purge port (first end 224) of the canister 222 and the vent line via the bypass passage 292 while blocking air-flow from the vent port of the canister to the vent line. Dashed line 274 shows a second direction of air flow through the canister during evacuation of the canister. In the second position of the three-way valve, as shown in the second mode, the canister 222 may be evacuated by drawing out air to the pump via the purge port of the canister and the bypass passage 292. The air flows from the vent port at the second end 226 to the purge port at the first end 224 of the canister and then to the pump of ELCM 295 via the bypass passage 292 and the vent line 227 upstream of the three-way valve 294. As the air flows in the second direction, HCs may migrate towards the first end 224.

In this way, in the first position of the three-way valve 294, the vent port of the canister is directly fluidically coupled to the vent line and fluid flow into the vent line via the bypass passage is blocked, and wherein in the second position of the three-way valve 294, the purge port is fluidically coupled to the vent line via the bypass passage and fluid floor into the vent line from the vent port of the canister is blocked. In the closed, third position of the three-way valve, the canister may be blocked form receiving fresh air from the vent line.

During the diagnostic routine, in response to the pressure at the ELCM reducing to or below a threshold pressure within the threshold duration, the canister 222 may be indicated to be robust and the three-way valve 294 may be actuated to the default first position. In response to the pressure at the ELCM not reducing to the threshold pressure within the threshold duration, the canister may be indicated to be degraded, and the three-way valve 294 may be actuated to a closed position to disable purging of the canister.

FIGS. 3A-3C show schematic depictions of example ELCM 295 in various conditions in accordance with the present disclosure. As shown in FIGS. 2A-2B, ELCM 295 may be located along vent 227 between canister 222 and atmosphere. ELCM 295 includes a changeover valve (COV) 315, a pump 330, and a pressure sensor 296. Pump 330 may be a vane pump, for example. In some examples, pump 330 may be a reversible pump, and thus configured to pump air in a first or second direction. COV 315 may be moveable between a first a second position. In the first position, as shown in FIGS. 3A and 3C, air may flow through ELCM 295 via first flow path 320. In the second position, as shown in FIG. 3B, air may flow through ELCM 295 via second flow path 325. The position of COV 315 may be controlled by solenoid 310 via compression spring 305 responsive to commands from controller 212. ELCM 295 may further comprise reference orifice 340. Reference orifice 340 may have a diameter corresponding to the size of a threshold leak to be tested, for example, 0.02". Regardless of whether COV 315 is in the first or second position, pressure sensor 296 may generate a pressure signal reflecting the pressure within ELCM 295. Operation of pump 330 and solenoid 310 may be controlled via signals received from controller 212.

As shown in FIG. 3A, COV 315 is in the first position, and pump 330 is activated in a first direction. Fuel tank isolation valve 252 (not shown) is closed, isolating ELCM 295 from the fuel tank. Air flow through ELCM 295 in this configuration is represented by arrows. In this configuration, pump 330 may draw a vacuum on reference orifice 340, and pressure sensor 296 may record the vacuum level within ELCM 295. This reference check vacuum level reading may then become the threshold for passing/failing a subsequent leak test.

As shown in FIG. 3B, COV 315 is in the second position, and pump 330 is activated in the first direction. This configuration allows pump 330 to draw a vacuum on fuel system 218 and/or EVAP system 251 when CPV 261 is closed. In examples where fuel system 218 includes FTIV 252, FTIV 252 may be opened to allow pump 330 to draw a vacuum on fuel tank 220, or FTIV 252 may be closed to allow pump 330 to draw a vacuum on canister 222. Air flow through ELCM 295 in this configuration is represented by arrows. In this configuration, as pump 330 pulls a vacuum on fuel system 218, the absence of a leak in the system should allow for the vacuum level in ELCM 295 to reach or exceed the previously determined vacuum threshold. In the presence of a leak larger than the reference orifice, the pump will not pull down to the reference check vacuum level.

As shown in FIG. 3C, COV 315 is in the first position, and pump 330 is de-activated. This configuration allows for air to freely flow between atmosphere and the canister. This configuration may be used during a canister purging operation, for example. In some examples, this configuration may be used during a refueling event or in other scenarios where fuel vapor is being ported from the fuel tank to the fuel vapor canister. In this way, gasses stripped of fuel vapor may be vented from the fuel vapor canister to atmosphere.

Performing a reference check with an internal reference orifice allows a leak threshold to be set that compensates for environmental conditions. However, such a leak threshold is not compensated for the canister loading state. If the leak test occurs while the canister is saturated with hydrocarbons, and/or if there is considerable fuel vapor in the fuel tank (e.g., hot fuel, highly volatile fuel) the vacuum pump may evacuate both air and hydrocarbons. This may lead to a false fail result. An ELCM vacuum pump may be a constant low flow pump, with a flow rate of 1 L/minute, for example. As fuel vapor is heavier than air, the pump becomes less efficient with increased hydrocarbon content in the evacuated gas. The reference threshold may thus fail to be met in the time allotted for the test.

In this way, the components described in FIGS. 1-3C enable evaporative emissions control (EVAP) system of an engine, comprising: a fuel vapor canister including a purge port at a first end coupled to an engine intake manifold via a purge line, and a vent port at a second end opening to atmosphere via a vent line, a bypass passage coupled across the canister, and a three-way valve coupled to a junction of the vent line and the bypass passage. The engine may further include a controller storing instructions in non-transitory memory that, when executed, cause the controller to: actuate the three-way valve to a first position upon onset of a diagnostic routine of the canister to enable air flow from the canister to a pump housed in the vent line via the vent port of the canister, and during the diagnostic routine, actuate the three-way valve to a second position to enable air flow from the canister to the pump via the purge port of the canister.

FIG. 5 shows a flow chart for a high-level method 500 for reducing a possibility of hydrocarbon (HC) breakthrough during a diagnostic routine of the EVAP system (such as EVAP system 251 in FIG. 2A) using an evaporative leak check module (such as ELCM 295 in FIG. 2A). Instructions for carrying out method 500 and other methods included herein may be executed by a controller based on instructions stored in a non-transitory memory of the controller and in conjunction with signals received from sensors of the engine system, such as the sensors described above with reference to FIGS. 1-2B. The controller may employ engine actuators of the engine system to adjust engine operation, according to the methods described below. Method 500 will be described with regards to the systems described herein and depicted in FIGS. 1, 2A-2B, and 3A-3C, but it should be understood that similar methods may be applied to other systems without departing from the scope of this disclosure.

Method 500 begins at 502 by estimating engine and vehicle operating conditions. The operating conditions may include engine operating status (engine load, engine temperature, engine speed), fuel level, fuel tank pressure, etc. A level of loading of the fuel vapor canister (such as canister 222 in FIG. 2A) of the EVAP system may be estimated based on output of an exhaust oxygen sensor, canister temperature sensors, and purging schedule of the canister. Operating conditions may also include ambient conditions, such as temperature, humidity, and barometric pressure, etc.

At 504, the method includes determining whether the entry conditions are met for an ELCM-based canister-side leak test. For example, entry conditions may include an engine-off condition, and/or an elapsed duration or number of engine-off events following a previous ELCM-based EVAP system leak test being higher than a threshold. In the canister side leak test, the fuel system is isolated from the canister and the diagnostic routine detects any leak in the canister, the purge line, and the vent line. If entry conditions are not met, method 500 proceeds to 506. At 506, current engine operation may be continued without initiation of EVAP system diagnostics. The ELCM system may be maintained inactive. A flag may be set to follow up at a subsequent key-off event, and/or when operating conditions favor a canister side diagnostic test.

If entry conditions are met for an ELCM-based, canister-side leak test, method 500 proceeds to 508. At 508, the method 500 includes performing an ELCM reference check. As discussed herein with regards to FIG. 3A, an ELCM reference check may comprise placing a COV in a first position and activating the ELCM vacuum pump. A pressure sensor, such as pressure sensor 296, may record the resulting vacuum level in the ELCM, after a pre-calibrated first amount of time, or when the vacuum level has reached a plateau.

At 510, the recorded vacuum level at the end of the reference check may be set as a basis for one or more thresholds to signify the expected vacuum attainable for a systemic leak with a diameter equivalent to the reference orifice. In some examples, the reference orifice has a diameter of 0.02", but may be smaller or greater in diameter in some embodiments. A vacuum threshold may be determined for the canister side of the emissions control system for a configuration where the FTIV and CPV are closed.

At 512, the three-way valve (such as three-way valve 294) coupled to the vent line between the canister and the ELCM system may be actuated to a first position to allow fluidic connection between the vent port of the canister and the vent line. The vent port may be the second end (such as second end 226 in FIG. 2A) of the canister proximal to the ELCM system. Referring to FIG. 2A, in the first position, the three-way valve directly connects the points C and B on the vent line while blocking direct connection (blocking A-B connection) of the canister bypass passage (such as bypass passage 292 in FIG. 2A) with the vent line. Further, a canister purge valve (such as CPV 261 in FIG. 2A) and a fuel tank isolation valve (such as FTIV 252 in FIG. 2A) may be actuated to their respective closed positions to isolate the canister from the engine intake manifold and the fuel system.

At 514, a vacuum may be applied to the fresh air side of the fuel vapor canister. As discussed herein with regards to FIG. 3B, applying a vacuum to the fuel vapor canister may comprise activating (or maintaining active) an ELCM vacuum pump on. As the pump is operated, air may be drawn out of the canister via the vent port at the second end. The air may flow from the purge line and the first end of the canister to the ELCM pump via the second end and the three-way valve. The vacuum may be applied to hydrocarbons (HCs) trapped in the canister and draw out the HCs to the vent line via the second end of the canister for a threshold duration. The threshold duration may be calibrated (such as by using a lookup table) based on the ELCM pump and pressure threshold set at step 510. As the vacuum is applied, pressure in the canister may be monitored via a pressure sensor coupled to the ELCM system (such as pressure sensor 296 in FIG. 2A) over the threshold duration.

At 516, during evacuation of the canister by the ELCM pump, a change in temperature (T) of the canister at the fresh air side such as proximal to the second end of the canister (away from the buffer) may be monitored via a temperature sensor (such as second temperature sensor 233 in FIG. 2A) over the threshold duration. Also, a change in temperature proximal to the first end of the canister may be monitored via another temperature sensor (such as first temperature sensor 232 in FIG. 2A) over the threshold duration.

FIG. 4A shows a first schematic depiction 400 of a fuel vapor canister 222 immediately after a purge of the canister 222 to the engine intake manifold. During the purge, a substantial amount of HCs stored in the canister is routed to the engine intake manifold via the purge line. Immediately after purging, a second part 412 of the canister 222 may not house any HC (clean part), while some HCs may be scattered within the buffer region 222*a* of the canister and a first part of the canister immediately following the buffer 222*a*.

FIG. 4B shows a schematic depiction 430 of the fuel vapor canister 222 during an evacuation of the canister via a vent port at the second end of the canister. During operation of the ELCM pump with the three-way valve in the first position, the second end 226 of the canister is directly coupled to the pump via the vent line. As the air is drawn out of the canister from the purge port at the first end 224 to the vent port at the second end 226, as shown by arrow 422, HCs within the canister are drawn from the first end 224 towards the second end 226. The amount of HC in the canister may be higher based on the duration elapsed since the immediately prior purge event. As the HC flows to the second end, the clean, second part 412 of the canister 222 shrinks. As HC flows adsorbed by the adsorbent in the canister, heat is generated and the temperature of the region of the canister where the HC is absorbed increases. Therefore, migration of the HCs towards the second end of the canister may be detected based on an increase in temperature recorded at the temperature sensor 233 positioned at 90% depth of the canister 222 relative to the first end 224. Therefore, if the temperature at the temperature sensor 233 records an increase, it may be inferred that the HCs may reach the 90% depth of the canister 222 relative to the first end 224 and is now proximal to the second end 226. Also, with the migration of HCs towards the second end, another temperature sensor positioned proximal to the buffer 222*a* may record a decrease in temperature. Due to the evacuation of the air to the vent line and the HC reaching proximal to the second end, there is a possibility of undesired HC breakthrough to the vent line during this process.

Returning to method 500 in FIG. 5, at 518, the method includes determining if the change in temperature (T) of the canister at the fresh air side is higher than a threshold change. The threshold change may be pre-calibrated based on heat generation during absorption of HC by the material within the canister. If it is determined that the change in temperature (T) of the canister at the fresh air side is lower than the threshold change within the threshold duration, it may be inferred that the HCs within the canister have not migrated to the fresh air side up to the 90% depth of the canister relative to the first end. Since the HCs have not reached the 90% depth of the canister relative to the first end, the possibility of HC breakthrough to the vent line is low. Therefore, at 522, pressure may be continued to be applied at the first side of the canister and the three-way valve may be maintained in the first position.

However, if it is determined that the change in temperature (T) of the canister at the fresh air side is higher than the threshold change within the threshold duration, it may be inferred that the HCs within the canister have migrated to the fresh air side up to the 90% depth of the canister relative to the first end and there is a possibility of HC breakthrough, if the migration of HCs is not suspended. By placing the temperature sensor at 90% depth of the canister, there is still 10% space within the canister to absorb any HCs migrating further.

In order to reverse the direction of HC flow within the canister, at 520, the three-way valve may be switched from the first position to the second position. By actuating the three-way valve to the second position, the purge port of the canister (the first end of the canister) may be connected to the vent line via the bypass passage. As an example, in FIG. 2B, points A and B are fluidically connected while blocking the connection between points C and B. In this way, fluids may not flow from the second end of the canister to the ELCM pump across the three-way valve.

Due to the connection between the first end of the canister and the vent line via the bypass passage and blocking the connection between the second end of the canister and the vent line, at 522, vacuum may be applied to the purge port (first end) of the canister. Air may be drawn out of the canister to the ELCM pump via the purge port at the first end, the bypass passage, and the vent line. Along with the air, HCs may also be drawn towards the first end of the canister and the buffer away from the second end, thereby reversing the direction of HC migration. In this way, possible migration of HCs to the second end of the canister and HC breakthrough to the vent line may be prevented. As the HCs flow towards the first end, the temperature recorded by the temperature sensor coupled proximal to the first end of the canister may increase.

FIG. 4C shows a schematic depiction 460 of the fuel vapor canister 222 during an evacuation of the canister via the vent port at a first end 224 of the canister. During operation of the ELCM pump with the three-way valve in the second position, the first end 224 of the canister is directly coupled to the pump via the bypass passage and the vent line. As the air is drawn out of the canister from the vent port at the second end 226 to the first end 224, as shown by arrow 424, HCs within the canister are drawn from second end 226 towards the first end 224. As the HC flows to the buffer 222*a*, the clean, second part 412 of the canister 222 expands. Migration of the HCs towards the first end of the canister may be detected based on a decrease in temperature recorded at the second temperature sensor 233 positioned at 90% depth of the canister 222 relative to the first end 224. With the migration of HCs towards the first end, another temperature sensor positioned proximal to the buffer 222*a* may record an increase in temperature. Due to the evacuation of the air to the vent line via the first end and the bypass passage, the possibility of undesired HC breakthrough to the vent line may be reduced.

Returning to FIG. 5, upon completion of the threshold duration of time, at 524, the routine includes determining if the pressure at the canister and EVAP system reduced to the pressure threshold set at step 510. As the vacuum pump pulls a vacuum on the fuel vapor canister, the absence of a leak in the system should allow for the vacuum level at the ELCM to reach or exceed the previously determined vacuum threshold within the threshold duration. In the presence of a leak larger than the reference orifice, the pump will not pull down to the reference check vacuum level within the threshold duration. If it is determined that the pressure threshold is reached or exceeded within the threshold duration, it may be inferred that there are no leaks (higher than size of ELCM reference) in the canister system. At 526, the canister may be indicated to be robust and the canister side diagnostics of the EVAP system may be concluded.

The routine may then proceed to step 532 wherein the EVAP system may be restored to the default settings. The default settings may include actuating the three-way valve to the first position to allow fluidic connection between the fresh air side of the canister and the vent line and block fluid flow into the bypass passage. Also, upon conclusion of the diagnostic routine, the ELCM pump may be deactivated, and the ELCM COV may be actuated to the first position.

If it is determined that the pressure threshold is not reached within the threshold duration, it may be inferred that there are leaks in the canister system. At 528, a flag (diagnostic code) may be set indicating the degradation of the canister. In order to mitigate the degradation, until the vehicle is serviced, at 530, the canister purge schedule may be updated. In one example, canister purging may be disabled and the three-way valve (or a canister vent valve) may be closed to block the canister form atmosphere. By blocking the canister from atmosphere, HC may not escape from the degraded canister to the atmosphere. Further, refueling may be requested (such as via a message to the operator) to be reduced until the canister is repaired/replaced. The routine may then proceed to 532 to restore the EVAP system to default settings. For a degraded canister, the default setting may include a closed three-way valve or canister vent valve.

In this way, during a diagnostic routine of a canister of the EVAP system, air may be routed through the canister in a first direction from a purge port of the canister to a vent port, and in response to a higher than threshold change in temperature of the canister proximal to the vent port, flow of air through the canister may be transitioned to a second direction from the vent port to the purge port. During flowing air through the canister in the first direction, a three-way valve coupled to the vent line may be maintained in a first position to allow fluidic communication between the vent port and the pump via the vent line. The transitioning to flowing air through the canister in the second direction may include actuating the three-way valve to a second position to allow fluidic communication between the purge port and the pump via a bypass passage coupled across the canister.

FIG. 6 shows an example operating sequence 600 for reducing a possibility of hydrocarbon (HC) breakthrough during a diagnostic routine of an evaporative emissions control (such as emissions EVAP system 251 in FIG. 2A) system in a vehicle. The diagnostic routine may include detecting degradation of a fuel vapor canister (such as fuel vapor canister 222 in FIG. 2A) using an evaporative leak check module (such as ELCM 295 in FIG. 2A system). The horizontal (x-axis) denotes time and the vertical markers t0-t3 identify significant times in the EVAP system diagnostics routine.

The first plot, line 602, denotes position of a change over valve (such as COV 315 in FIG. 3A) of the ELCM system. In the first portion, the COV establishes direct communication of the canister and the atmosphere without the pump in between, and in the second position, the COV establishes communication of a pump of the ELCM system with the canister. The second plot, line 604, denotes operation of the ELCM pump which is configured to evacuate the canister during a diagnostic routine. The third plot, line 606, denotes a pressure in the canister as estimated via an ELCM pressure sensor (such as ELCM pressure sensor 296 in FIG. 2A) during the diagnostic routine. Dashed line 605 denotes a pre-calibrated threshold vacuum level if attained with a threshold duration (between time t1 and t3), it can be inferred that the canister is robust. The fourth plot, line 610, denotes a position of a three-way valve regulating fluid flow between the vent line, the canister, and a bypass passage (such as bypass passage 292 in FIG. 2A) of the canister. In the first position, the three-way valve allows fluidic connection between the vent port of the canister (the second end of the canister) and the vent line. In the second position, the three-way valve allows the purge port of the canister (the first end of the canister) to be connected to the vent line via the bypass passage. In the closed position, the three-way valve blocks flow of fresh air downstream of the three-way valve. The fifth pot, line 612, denotes a change in temperature of a canister proximal to the second end of the canister during the diagnostic routine, as estimated by a temperature sensor (such as second temperature sensor 233 in FIG. 2A) positioned at 90% depth of the canister relative to the first end. Dashed line 611 denotes a pre-calibrated threshold temperature change above which change in direction of air flow through the canister is desired to inhibit HC breakthrough. The sixth plot, line 614, denotes a direction of air flow through the canister based on the position of the three-way valve. In the first position of the three-way valve, the air flow through the canister is in a first direction, from first end to second end, while in the second position of the three-way valve, the air flow through the canister is in a second direction, from second end to first end. The seventh pot, line 616, denotes a flag indicating degradation of the canister.

Diagnostics of the canister side of the EVAP system may be initiated at time t0. In order to diagnose the canister, the three-way valve is actuated to the first position to allow fluidic connection between the fresh air side of the canister (the second end of the canister) and the vent line. The canister purge valve and the fuel tank isolation valve (not shown) are maintained in their closed positions to isolate the canister form the engine intake manifold and the fuel system. The COV valve is actuated to the second position to stablish communication of the pump of the ELCM system with the canister. The ELCM pump may be activated to evacuate the canister over a threshold duration (between time t0 and t3). The direction of air-flow within the canister is the first direction (e.g., air flowing from the first end to the vent line via the second end).

The pressure in the canister is monitored via the ELCM pressure sensor and is observed to decay over time. As the canister is evacuated, HCs present within the canister migrates from the first end of the canister towards the second end of the canister. The flow of HCs towards the second end, causes an increase in canister temperature proximal to the second end. At time t1, in response to the increase in canister temperature to the threshold temperature 611, it is inferred that the HCs have reached 90% depth of the canister relative to the first end and further migration towards the second end increases the possibility of HC breakthrough. Therefore, at time t1, the three-way valve is actuated to the second position allowing the buffer part of the canister (the first end of the canister) to be connected to the vent line via the bypass passage while the second end of the canister is blocked from direct communication with the vent line.

With the three-way valve in the second position, the direction of air flow through the canister is revered with the air flowing from the second end to the first end. With change in direction of air flow through the, the HCs will start migrating from the second end to the first end of the canister, thereby reducing the possibility of the HCs to breakthrough to the vent line via the second end. Between time t1 and t2, the canister is evacuated via the first end of the canister and the bypass passage.

At time t2 prior to elapsing of the threshold time at t3, the ELCM pressure reduces to the threshold pressure 605. Therefore, it is inferred that the canister side of the EVAP system is robust without any significant degradation and the flag is maintained in off position. The EVAP system diagnostics is concluded at time t2.

Upon completion of the diagnostics, at time t2, the ELCM pump is deactivated. The COV is actuated to the first position to establish direct communication of the canister and the atmosphere without the pump in between. The three-way valve is actuated to the default first position. Upon actuating the COV to the first position, the EVAP system is vented and the ELCM pressure increases.

However, in an alternate situation, if at time t3 it was observed that the ELCM pressure did not reduce to the threshold pressure 605, such as shown by dashed line 608, it would have been inferred that the canister is degraded and as indicated by dashed line 615, a flag would be set indicating the degradation. In response to the detection of degradation in the canister, the three-way valve is actuated to the closed position to inhibit communication of the canister with atmosphere such that HCs may not escape to the atmosphere.

In this way, by including a three-way valve in the event line of an EVAP system, it is possible to regulate direction of air flow within a fuel vapor canister during canister diagnostics. By opportunistically changing the direction of air-flow within the canister, possibility of HC breakthrough may be reduced. The technical effect of tracking temperature within the canister is that, HC migration within the canister may be monitored and used for changing the direction of air flow within the canister. Overall by effectively diagnosing the EVAP system while reducing the possibility of HC breakthrough, emissions quality may be maintained above desired levels.

An example method for an engine comprises: during a diagnostic routine of a fuel vapor canister of an evaporative emissions control (EVAP) system, switching a direction of air-flow through the canister based on a change in temperature within the canister. In any of the preceding examples, additionally or optionally, the diagnostic routine includes, isolating the canister from a fuel system and an engine intake manifold, evacuating the canister via a pump of an evaporative leak check module (ELCM) coupled to a vent line of the EVAP system over a threshold duration, and monitoring a pressure at the ELCM via an ELCM pressure sensor. Any or all of the preceding examples, the method further comprising, additionally or optionally, at an onset of the diagnostic routine, actuating a three-way valve coupled to the vent line of the EVAP system between the canister and the pump to a first position to allow direct fluidic communication between a vent port of the canister and the pump while blocking air-flow from a bypass passage of the canister to the vent line. In any or all of the preceding examples, additionally or optionally, the bypass passage is coupled at a first end to a purge line of the EVAP system proximal to a purge port of the canister and at a second end to the vent line proximal to the vent port of the canister. In any or all of the preceding examples, additionally or optionally, the change in temperature within the canister is monitored during the diagnostic routine via a temperature sensor coupled within the canister proximal to the vent port of the canister. In any or all of the preceding examples, additionally or optionally, the switching in direction is in response to the change in temperature within the canister being higher than a threshold change over the threshold duration, the change in temperature being an increase in temperature. In any or all of the preceding examples, additionally or optionally, the switching the direction of air-flow includes actuating the three-way valve to a second position to allow fluidic communication between a purge port of the canister and the vent line via the bypass passage while blocking air-flow from the vent port of the canister to the vent line. In any or all of the preceding examples, additionally or optionally, in the first position of the three-way valve, the canister is evacuated by drawing out air to the pump via the vent port of the canister, and wherein in the second position of the three-way valve, the canister is evacuated by drawing out air to the pump via the purge port of the canister and the bypass passage. Any or all of the preceding examples, the method further comprising, additionally or optionally, in response to the pressure at the ELCM reducing to a threshold pressure within the threshold duration, indicating the canister to be robust and actuating the three-way valve to the first position. Any or all of the preceding examples, the method further comprising, additionally or optionally, in response to the pressure at the ELCM not reducing to the threshold pressure within the threshold duration, indicating the canister to be degraded, and actuating the three-way valve to a closed position to disable purging of the canister.

Another example method for an evaporative emissions control (EVAP) system in an engine, comprises: during a diagnostic routine of a canister of the EVAP system, flowing air through the canister in a first direction from a purge port of the canister to a vent port, and in response to a higher than threshold change in temperature of the canister proximal to the vent port, transitioning to flowing air through the canister in a second direction from the vent port to the purge port. In the preceding example, additionally or optionally, the flowing of air through the canister is due to evacuation of the canister via operation of a pump of an evaporative leak check module (ELCM) coupled to a vent line of the EVAP system for a threshold duration. In any or all of the preceding examples, additionally or optionally, during flowing air through the canister in the first direction, a three-way valve coupled to the vent line is maintained in a first position to allow fluidic communication between the vent port and the pump via the vent line. In any or all of the preceding examples, additionally or optionally, the transitioning to flowing air through the canister in the second direction includes actuating the three-way valve to a second position to allow fluidic communication between the purge port and the pump via a bypass passage coupled across the canister. In any or all of the preceding examples, additionally or optionally, in the first position of the three-way valve, air-flow from the purge port of the canister to the pump via the bypass passage is blocked wherein in the second position of the three-way valve, air-flow from the vent port of the canister to the pump is blocked. In any or all of the preceding examples, additionally or optionally, the higher than threshold change in temperature of the canister is estimated via a temperature sensor coupled within the canister proximal to the vent port of the canister.

Another example for an evaporative emissions control (EVAP) system of an engine, comprises: a fuel vapor canister including a purge port at a first end coupled to an engine intake manifold via a purge line, and a vent port at a second end opening to atmosphere via a vent line, a bypass passage coupled across the canister, and a three-way valve coupled to a junction of the vent line and the bypass passage. The preceding example, further comprising, additionally or optionally, a controller storing instructions in non-transitory memory that, when executed, cause the controller to: actuate the three-way valve to a first position upon onset of a diagnostic routine of the canister to enable air flow from the canister to a pump housed in the vent line via the vent port of the canister, and during the diagnostic routine, actuate the three-way valve to a second position to enable air flow from the canister to the pump via the purge port of the canister. In any or all of the preceding examples, additionally or optionally, in the first position of the three-way valve, the vent port of the canister is directly fluidically coupled to the vent line, and fluid flow into the vent line via the bypass passage is blocked, and wherein in the second position of the three-way valve, the purge port is fluidically coupled to the vent line via the bypass passage and fluid floor into the vent line from the vent port of the canister is blocked. In any or all of the preceding examples, additionally or optionally, the controller includes further instructions to: indicate degradation of the canister in response to a pressure in the EVAP system not reducing to a threshold pressure within a threshold duration, and in response to the indication of degradation, actuate the three-way valve to a closed position.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine, comprising:

during a diagnostic routine of a fuel vapor canister of an evaporative emissions control (EVAP) system, switching a direction of air-flow through the canister based on a change in temperature within the canister.

2. The method of claim 1, wherein the diagnostic routine includes, isolating the canister from a fuel system and an engine intake manifold, evacuating the canister via a pump of an evaporative leak check module (ELCM) coupled to a vent line of the EVAP system over a threshold duration, and monitoring a pressure at the ELCM via an ELCM pressure sensor.

3. The method of claim 2, further comprising, at an onset of the diagnostic routine, actuating a three-way valve coupled to the vent line of the EVAP system between the canister and the pump to a first position to allow direct fluidic communication between a vent port of the canister and the pump while blocking air-flow from a bypass passage of the canister to the vent line.

4. The method of claim 3, wherein the bypass passage is coupled at a first end to a purge line of the EVAP system proximal to a purge port of the canister and at a second end to the vent line proximal to the vent port of the canister.

5. The method of claim 3, wherein the change in temperature within the canister is monitored during the diagnostic routine via a temperature sensor coupled within the canister proximal to the vent port of the canister.

6. The method of claim 3, wherein the switching in direction is in response to the change in temperature within the canister being higher than a threshold change over the threshold duration, the change in temperature being an increase in temperature.

7. The method of claim 3, wherein the switching the direction of air-flow includes actuating the three-way valve to a second position to allow fluidic communication between a purge port of the canister and the vent line via the bypass passage while blocking air-flow from the vent port of the canister to the vent line.

8. The method of claim 7, wherein in the first position of the three-way valve, the canister is evacuated by drawing out air to the pump via the vent port of the canister, and wherein in the second position of the three-way valve, the canister is evacuated by drawing out air to the pump via the purge port of the canister and the bypass passage.

9. The method of claim 7, further comprising, in response to the pressure at the ELCM reducing to a threshold pressure within the threshold duration, indicating the canister to be robust and actuating the three-way valve to the first position.

10. The method of claim 9, further comprising, in response to the pressure at the ELCM not reducing to the threshold pressure within the threshold duration, indicating the canister to be degraded, and actuating the three-way valve to a closed position to disable purging of the canister.

11. A method for an evaporative emissions control (EVAP) system in an engine, comprising:

during a diagnostic routine of a canister of the EVAP system, flowing air through the canister in a first direction from a purge port of the canister to a vent port; and in response to a higher than threshold change in temperature of the canister proximal to the vent port, transitioning to flowing air through the canister in a second direction from the vent port to the purge port.

12. The method of claim 11, wherein the flowing of air through the canister is due to evacuation of the canister via operation of a pump of an evaporative leak check module (ELCM) coupled to a vent line of the EVAP system for a threshold duration.

13. The method of claim 12, wherein during flowing air through the canister in the first direction, a three-way valve coupled to the vent line is maintained in a first position to allow fluidic communication between the vent port and the pump via the vent line.

14. The method of claim 13, wherein the transitioning to flowing air through the canister in the second direction includes actuating the three-way valve to a second position to allow fluidic communication between the purge port and the pump via a bypass passage coupled across the canister.

15. The method of claim 14, wherein in the first position of the three-way valve, air-flow from the purge port of the canister to the pump via the bypass passage is blocked wherein in the second position of the three-way valve, air-flow from the vent port of the canister to the pump is blocked.

16. The method of claim 14, wherein the higher than threshold change in temperature of the canister is estimated via a temperature sensor coupled within the canister proximal to the vent port of the canister.

17. An evaporative emissions control (EVAP) system of an engine, comprising:

a fuel vapor canister including a purge port at a first end coupled to an engine intake manifold via a purge line, and a vent port at a second end opening to atmosphere via a vent line;

a bypass passage coupled across the canister; and a three-way valve coupled to a junction of the vent line and the bypass passage.

18. The system of claim 17, further comprising:

a controller storing instructions in non-transitory memory that, when executed, cause the controller to:

actuate the three-way valve to a first position upon onset of a diagnostic routine of the canister to enable air flow from the canister to a pump housed in the vent line via the vent port of the canister; and during the diagnostic routine, actuate the three-way valve to a second position to enable air flow from the canister to the pump via the purge port of the canister.

19. The system of claim 18, wherein in the first position of the three-way valve, the vent port of the canister is directly fluidically coupled to the vent line, and fluid flow into the vent line via the bypass passage is blocked, and wherein in the second position of the three-way valve, the purge port is fluidically coupled to the vent line via the bypass passage and fluid floor into the vent line from the vent port of the canister is blocked.

20. The system of claim 18, wherein the controller includes further instructions to: indicate degradation of the canister in response to a pressure in the EVAP system not reducing to a threshold pressure within a threshold duration, and in response to the indication of degradation, actuate the three-way valve to a closed position.

* * * * *